US007613315B2

(12) United States Patent
Vaerum et al.

(10) Patent No.: US 7,613,315 B2
(45) Date of Patent: Nov. 3, 2009

(54) CONFIGURABLE HEADSET

(75) Inventors: Peter Vestergaard Vaerum, Solrød Strand (DK); Sivert Wernblad, Solrød Strand (DK); Jeppe Marckmann Ørsted, Solrød Strand (DK)

(73) Assignee: Sennheiser Communications A/S, Solrod Strand (DK)

( * ) Notice: Subject to any disclaimer, the term of this patent is extended or adjusted under 35 U.S.C. 154(b) by 783 days.

(21) Appl. No.: 11/364,551

(22) Filed: Mar. 1, 2006

(65) Prior Publication Data

US 2006/0198543 A1 Sep. 7, 2006

(30) Foreign Application Priority Data

Mar. 4, 2005 (EP) ..... 05101702

(51) Int. Cl.
*H04R 25/00* (2006.01)

(52) U.S. Cl. ..... 381/381; 381/374; 381/375

(58) Field of Classification Search ..... 381/309, 381/330, 370, 371, 373, 374, 375, 378, 379, 381/381; 379/420.02, 420.03, 430, 433.02, 379/433.03; 181/128, 129, 130, 135
See application file for complete search history.

(56) References Cited

U.S. PATENT DOCUMENTS

| | | | | |
|---|---|---|---|---|
| 5,450,496 | A * | 9/1995 | Burris et al. | 381/375 |
| 5,761,298 | A | 6/1998 | Davis et al. | |
| 6,097,827 | A * | 8/2000 | Yang | 381/375 |
| 6,154,539 | A | 11/2000 | Pitel | |
| 7,391,878 | B2 * | 6/2008 | Liao | 381/370 |
| 2004/0055811 | A1 | 3/2004 | Shih | |

FOREIGN PATENT DOCUMENTS

| | | |
|---|---|---|
| EP | 1278394 | 1/2003 |
| GB | 2347042 | 8/2000 |

* cited by examiner

*Primary Examiner*—Huyen D Le
(74) *Attorney, Agent, or Firm*—Dykema Gossett PLLC

(57) ABSTRACT

The headset according to the invention has an elongate cabinet adapted for placement behind the ear lobe, a speaker enclosure hinged to the cabinet part and extending downwards from the upper portion of the cabinet part and a microphone boom extending from the lover tip of the cabinet part. The microphone boom is fastened to the cabinet part in rotatable fashion, and the speaker enclosure has sound exit openings pointing in a direction toward the ear and away from the ear. According to the invention the speaker enclosure has a circumferentially extending band which is detachable from the speaker enclosure.

8 Claims, 9 Drawing Sheets

CONFIGURABLE HEADSET

AREA OF THE INVENTION

The invention relates to a headset which is configurable to the needs and ear size of different users.

BACKGROUND OF THE INVENTION

Headsets are used for transmitting phone calls between a telephone and a head-worn device usually associated with an ear. The head-worn device comprises a microphone and a speaker and electronics as well as mechanical parts. The head worn device is usually associated with one ear of the user, and here it is desired, that the user may freely change the head worn device from ear to ear also during use of the device. Further, some users have a preference for a head band wearing style, where the headset being associated with one ear has a carrying band which extends above the head and provides support for the headset at both sides of the head. When the head-band style is used, switch of the head set from ear to ear should also be possible.

SUMMARY OF THE INVENTION

The headset according to the invention solves the above problems by providing a headset having an elongate cabinet adapted for placement behind the ear lobe, a speaker enclosure hinged to the cabinet part and extending downwards from the upper portion of the cabinet part and a microphone boom extending from the lover tip of the cabinet part, wherein the microphone boom is fastened to the cabinet part in rotatable fashion, and wherein the speaker enclosure has sound exit openings pointing in a direction toward the ear and away from the ear. According to the invention the speaker enclosure has a circumferentially extending band which is detachable from the speaker enclosure.

Hereby it becomes possible to use bands with different diameters to better fit the ear of the individual user. When a speaker which radiates sound both towards and away from the ear is used, it is very important that the speaker opening be placed very near the ear canal as the sound pressure from the speaker drops rapidly with the distance from the sound radiating openings. The diameter of the band for placement on the circumference of the speaker cabinet is chosen by the user to ensure that the speaker opening is always placable in the right position.

When the headset is used the elongate cabinet part is placed behind the ear and the speaker enclosure is pivoted towards the cabinet part and pinches the ear lobe between the speaker enclosure and the elongate cabinet part. The right diameter of the speaker enclosure obtained by means of the chosen band aids to ensure that the sound orifice will be placed near the ear canal when the speaker enclosure is pivoted to the right position toward the ear lobe. Once fitted to the user's ear the headset may at any time be shifted from one ear to the other without further ado. The speaker enclosure fitted to one ear, by choosing the right band diameter, will fit the other ear as well and as the sound is radiated from both sides of the speaker enclosure, the shift from one to the other ear can be done without having to turn the speaker around. The simple pivotal movement realized by the hinge between cabinet part and speaker enclosure will ensure, that the speaker is very easy for the user to position outside of the ear canal of the other ear, and the microphone boom is easily rotated around its length axis to come into position near the user's mouth.

In an embodiment of the invention the speaker enclosure is round. This allows a simple round band to follow the circumference of the speaker enclosure. Preferably the band has an U or V shaped cross section in order to stay fastened to the speaker enclosure. The speaker enclosure provides a corresponding profile for a nice fit of the band to the speaker enclosure.

In a preferred embodiment a short arm is provided from the circumference of the speaker enclosure to the pivotal link at the headset cabinet and further, the band extending around the speaker enclosure is interrupted in the area of the arm.

In a further aspect of the invention a headband for a headset is proved whereby the headband comprises a band extending over the head of a user and where the band has a soft part for engaging the head at one end thereof and a connector for connecting a head-set at the other end thereof, whereby the connector comprises two shells hinged together to allow a closing and opening movement, and whereby the shells defines a hollow space when closed for accommodating a speaker enclosure of a headset as defined above, when the shells are closed.

With a headband of the above kind it is possible to use the headset also with a headband, which may be preferred, especially by those who use the headset during many hours of the day. The two shells are clamped around the speaker cabinet, and the headband is placed across the head and holds the speaker cabinet in place near the ear canal of the user. The two shells may at any time be opened to relieve the headset for use in behind the ear style again. Thus, the user has maximum flexibility with the headset and the headband. The hollow space defined by the closed shells is dimensioned to allow the speaker to be accommodated regardless of the band diameter chosen by the user.

In a preferred embodiment the hollow space between the shells is defined by a ridge member which has at least two interruptions when the shells are closed, to allow the arm holding the speaker enclosure to extend outside the enclosure in the area of the interruptions. By having two interruptions, the speaker enclosure may be clamped such that the headset cabinet is extending to either side in relation to the headband. Hereby the headset may be shifted from one to the other ear also when the headband wearing stile is used, and this shift is simply carried out by opening the clamping shells, turning the headset over and closing the shells again.

Preferably the clamping shells of the headband are both provided with sound orifices allowing sound from the speaker to exit. It is most important that the sound be allowed to radiate from the speaker, also in the direction away from the ear, or otherwise the sound field around the speaker enclosure is disturbed, and the sound radiating towards the ear changes.

Preferably the shell part facing the ear has a central sound guiding opening and a radially extending collar.

The collar allows an ear pad to be easily attached to the shell part, such that the user may choose an ear pad according to his or her liking.

DESCRIPTION OF A PREFERRED EMBODIMENT

Figure 1:
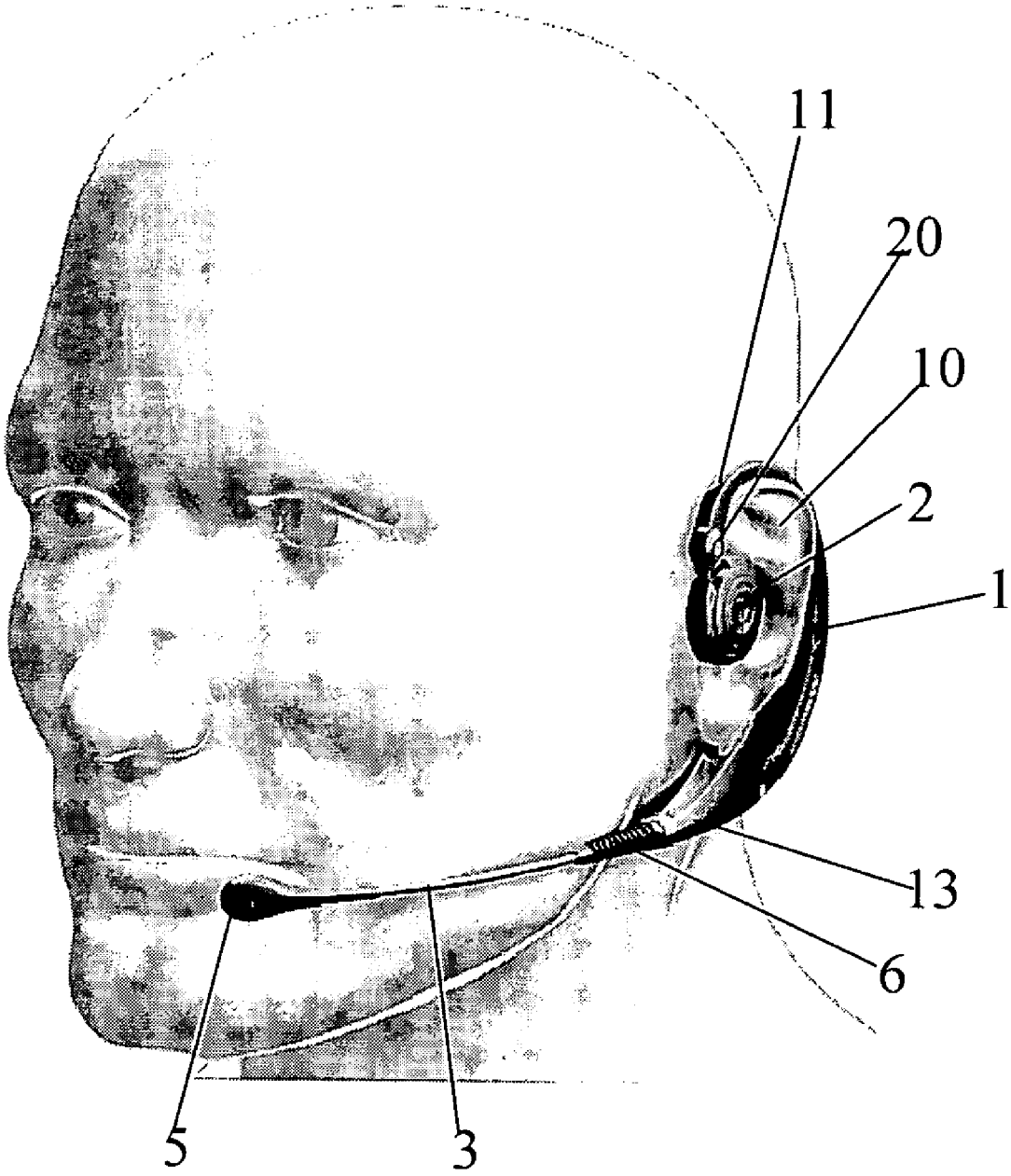
FIG. 1 shows a head with a head-set according to the invention on the ear.
Figure 2:
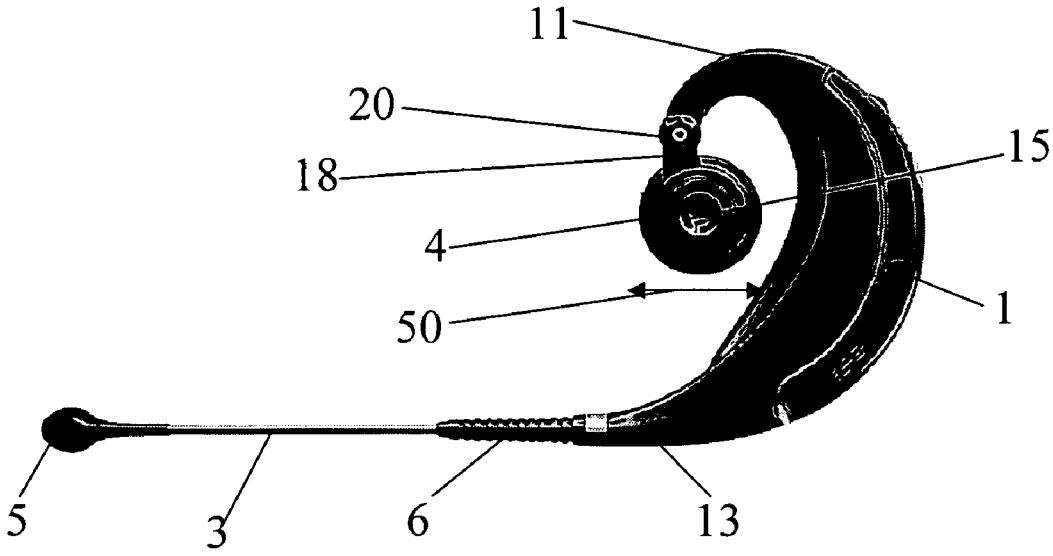
FIG. 2 shows a side view of a headset according to the invention.

The head-set shown in FIGS. 1 and 2 comprises an elongate cabinet part 1 and as seen in FIG. 1 this part is shaped to sit behind the ear 10 of a user. The cabinet has a microphone boom 3 extending from the lower tip portion 13 thereof and from the top portion 11 a speaker enclosure 2 is pivotally hinged and as seen in FIG. 1 the speaker enclosure 2 extends downward in front of the ear. The top portion 11 of the cabinet 1 has a hook-like appearance which allows the cabinet 1 to hang on the ear, such that the tip portion of the hook is in front of the ear. A link 20 is provided at the tip of the hook portion. Further a short arm 18 interconnects the link 20 and the speaker enclosure 2. This allows the sound producing orifices 15 of the speaker enclosure 2 to swing back and forth as show by arrow 50. Sound producing orifices are provided at both sides of the speaker enclosure, the sound will thus be radiated in two opposite directions when the speaker is active. Correct placement of the headset is achieved by hanging the cabinet 1 onto the ear as seen in FIG. 1 and then swing the speaker enclosure 2 back towards the ear lobe to achieve a light pinching action between the cabinet portion 1 behind the ear and the speaker enclosure 2.

Figure 3:
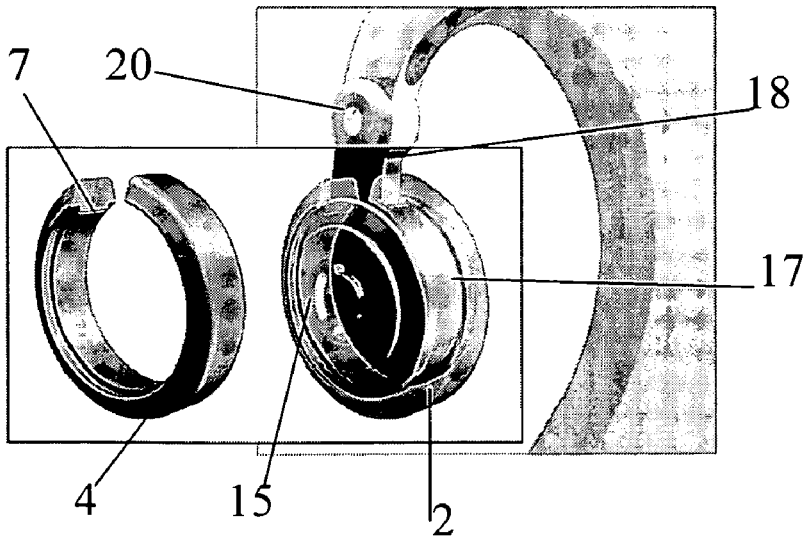
FIG. 3 shows the speaker enclosure and one of the bands for adjusting size.

When the headset is placed on the ear as described above the sound producing orifice turned towards the ear should preferably be placed right outside the ear canal. But as ears differs from person to person a further adjustment possibility is arranged, namely adjustment band 4. This band 4 is placed circumferential around speaker enclosure 2 and maintained in a U-shaped furrow 17 of the speaker enclosure 2. As seen in FIG. 3 the band 4 is circular in shape, but has an opening 7 which allows the arm 18 to extend radially from the speaker enclosure 2. The band 4 is made of a flexible material and is easily exchanged. Bands of varying outer diameter will be provided with each headset to allow the user to choose a size of the speaker enclosure which suits his or her ear the best.

When the right size band 4 is chosen the user has the following advantages: the force used to fixate the headset works perpendicular to the headset, almost in the centre of gravity, which helps to stabilize the headset on the ear. Thus the receiver enclosure is pressed gently and directly towards the ear, and no turning moment which could twist the headset will be exerted from the weight of the headset. The pressure exerted on the ear works in the least sensitive parts of the ear. The adjustment to the different sizes and sicknesses of the ears is made partially with the friction in the link 20, and partially through a number of different sizes of adjustment rings. Preferably three different sizes of the ring 4 are provided with each headset, as this covers the needs of most users.

The microphone boom 3 is fastened to the lower tip 13 of the cabinet 1 such that it is rotatable about its length axis. As seen in FIG. 1 the boom 3 is slightly curved at its outer end in order that the microphone 5 is correctly placed near the user's mouth. When the head-set is moved to the opposite ear the boom 3 may simply be rotated to come into the right position. At the base 6 of the boom a flexible region is provided allowing the user to further adjust the boom 3 in any desired direction. The headset is a wireless headset using the Bluetooth transmission protocol for wireless transmission of the telephone signals to and from a base station which again by wire is coupled to the telephone. This is a well known concept. The microphone boom 3 functions as the antenna of the Bluetooth transmitter at the same time. The boom 3 is thus made of metal and is electrically connected to the signal processing parts of the headset.

Moving the above described headset from one to the other ear is thus straight forward and can be done at any time. The headset is simply taken off the ear, placed at the other ear, the speaker enclosure is pivoted to come in alignment with the ear canal and the microphone boom 3 turned to the right position near the mouth.

The head-set further comprises buttons, a rechargeable battery and a light diode to show the status of the head-set. This all is common in modern head-sets and is not described further.

Figure 4:
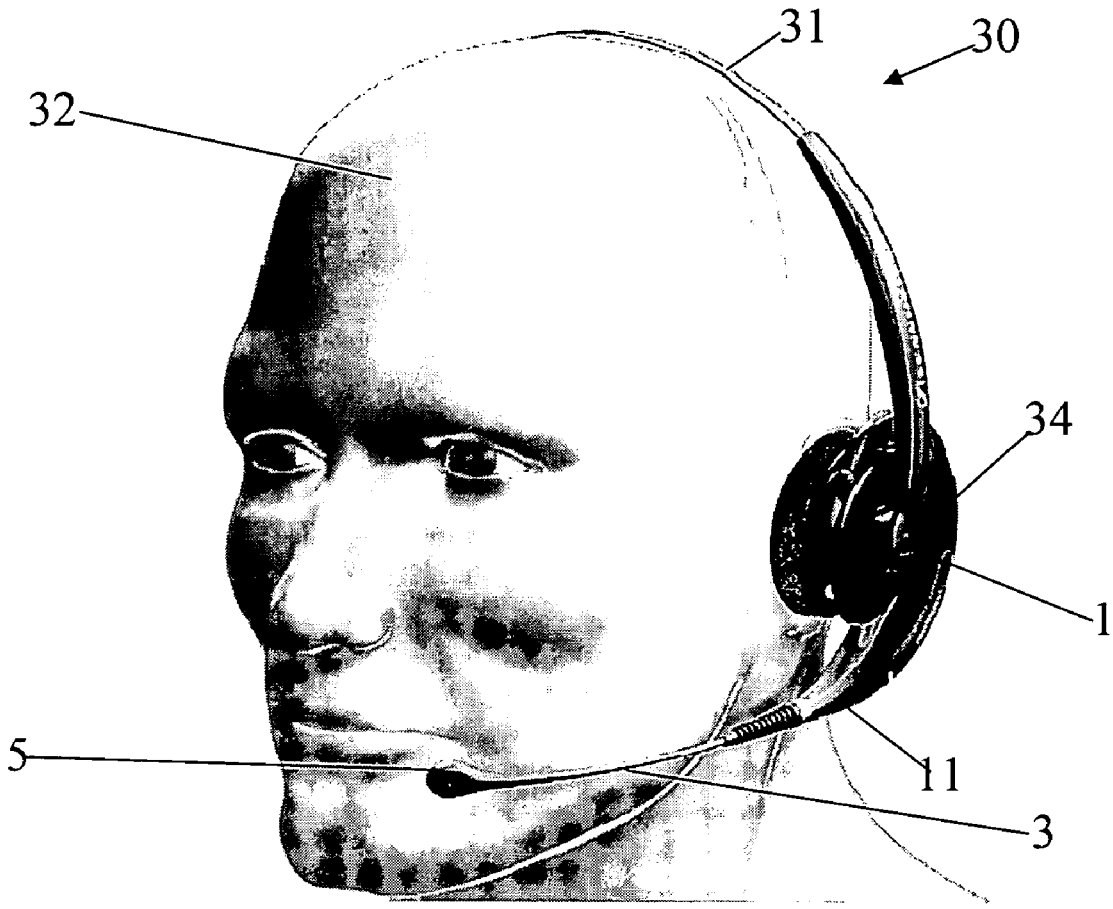
FIG. 4 shows a head with the head-set in a head-band.
Figure 5A:
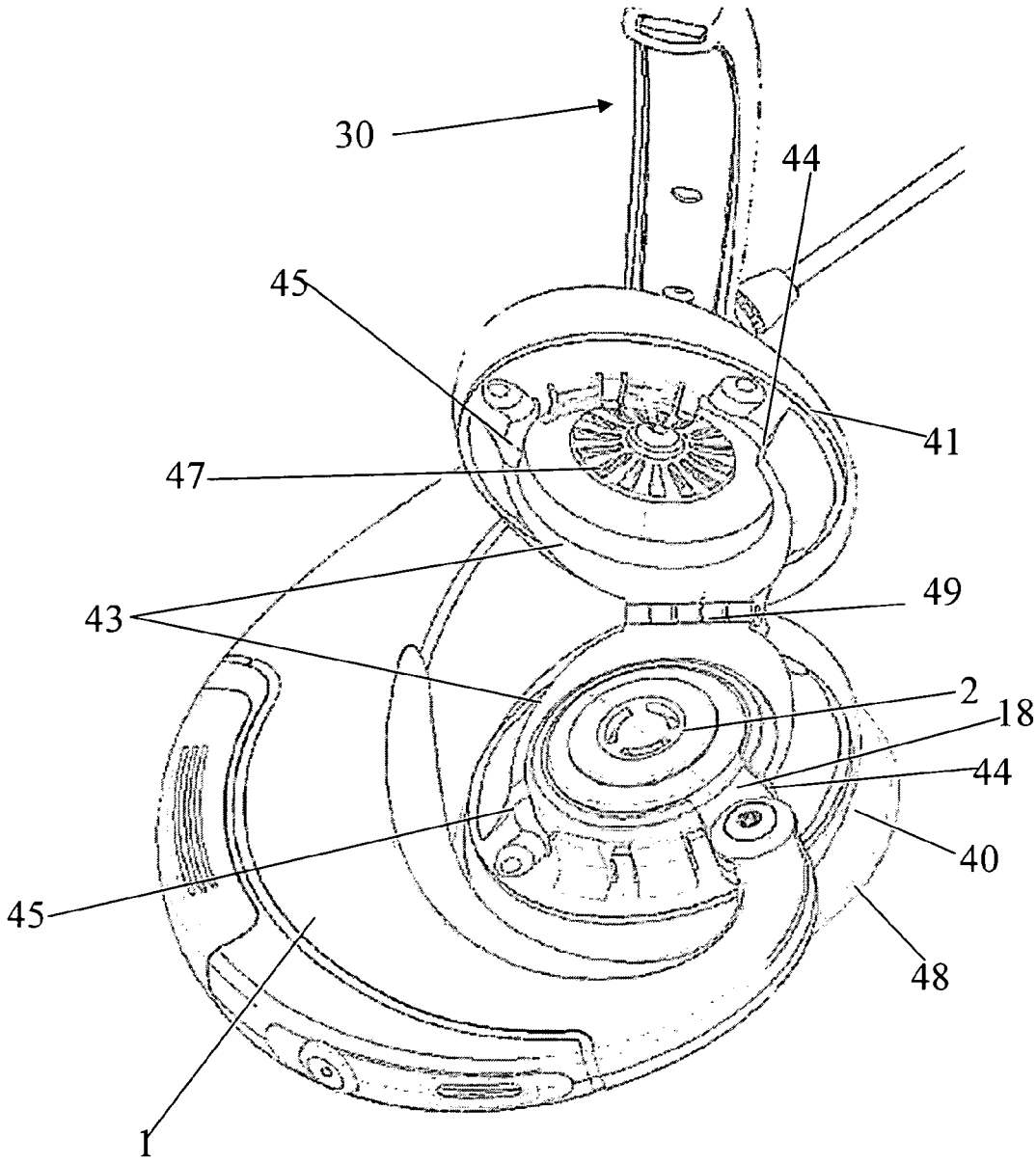
FIGS. 5*a* and 5*b* is perspective views of a the head-band and headset with the headset arranged at two sides.
Figure 5B:
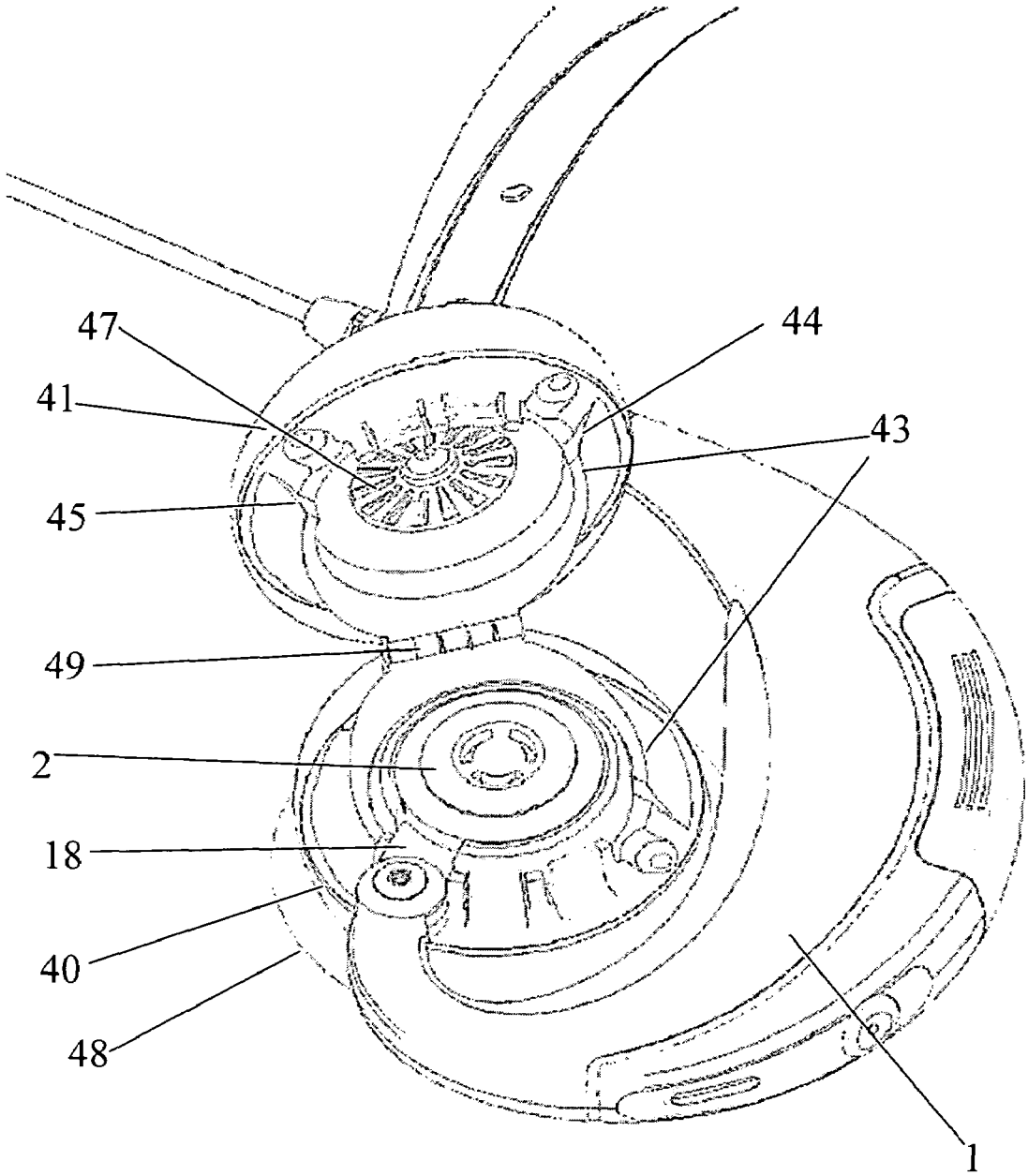
Figure 5C:
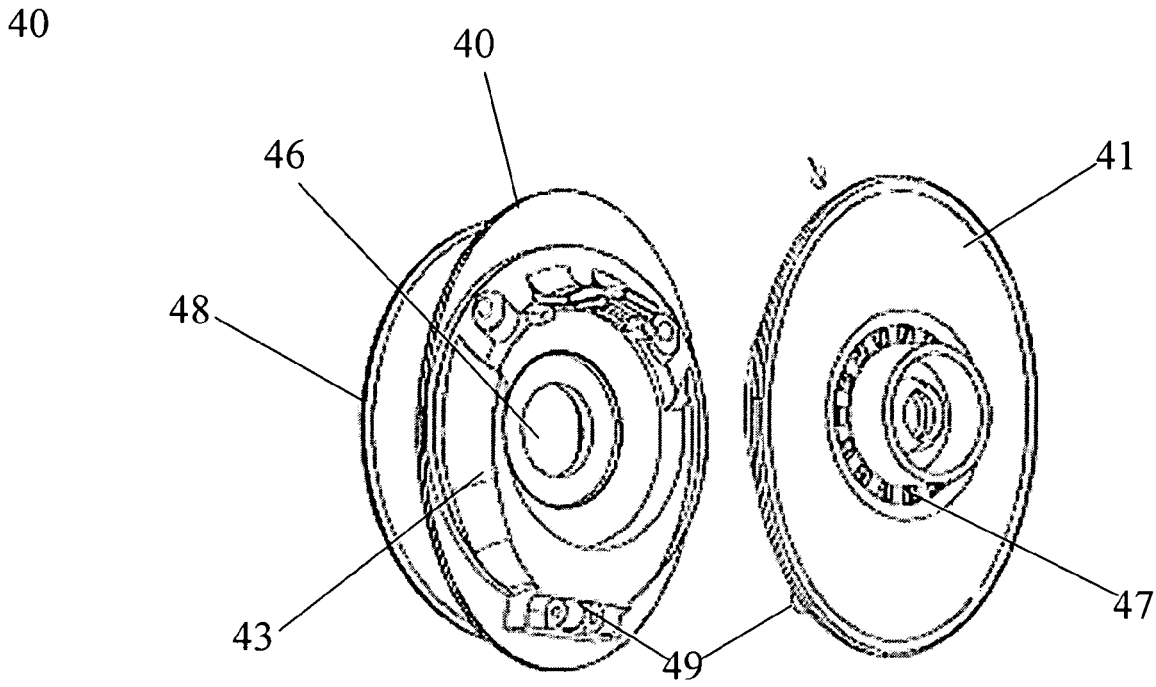
FIG. 5*c* shows an exploded view of the two shells of the headband.

The head-set may be used hanging on the ear as described, or it can be used with a head-band 30 as shown in FIG. 4. This headband waring style is preferred by some users and relieves the ear lobe 10 of the weight from the head-set. The headband 30 comprises a first end with a soft support 33 and a second end with a connector 34. A band 3 extends over the head 32 between the support 33 and the connector 34 when the headband is worn. The connector 34 is coupled to a shell part 41, which again is hinged at its periphery to a corresponding shell part 40, such that the two shell parts 40,41 may swing to open or close a space defined between the shells 40,41. The shell parts 40,41 are described in more detail in the following with reference to FIGS. 5*a-c*. The hinge parts are shown at numeral 49. A ridge 43 on the shells 40,41 defines an enclosure when the shells 40,41 are closed. The ridge 43 is made with an internal diameter which allows the speaker enclosure 2 of the head-set to be accommodated and enclosed between the shells 41,40, irrespective of the band 4 diameter chosen by the user. The ridge 43 has two interruptions 44,45 allowing the arm 18 to extend out between the shells 41,40 when the speaker enclosure 2 is accommodated between the shells. The two interruptions 44,45 allows the headset to be placed such that the cabinet 1 will be at either side of the shells as clearly seen in FIG. 5*a* and FIG. 5*b*, thus allowing the user to freely choose which ear the head-set should be placed at. Between the interruptions 44,45 the ridge 43 is provided with usual click element to allow interlocking of the shells 40, 41 once pressed together.

Figure 6:
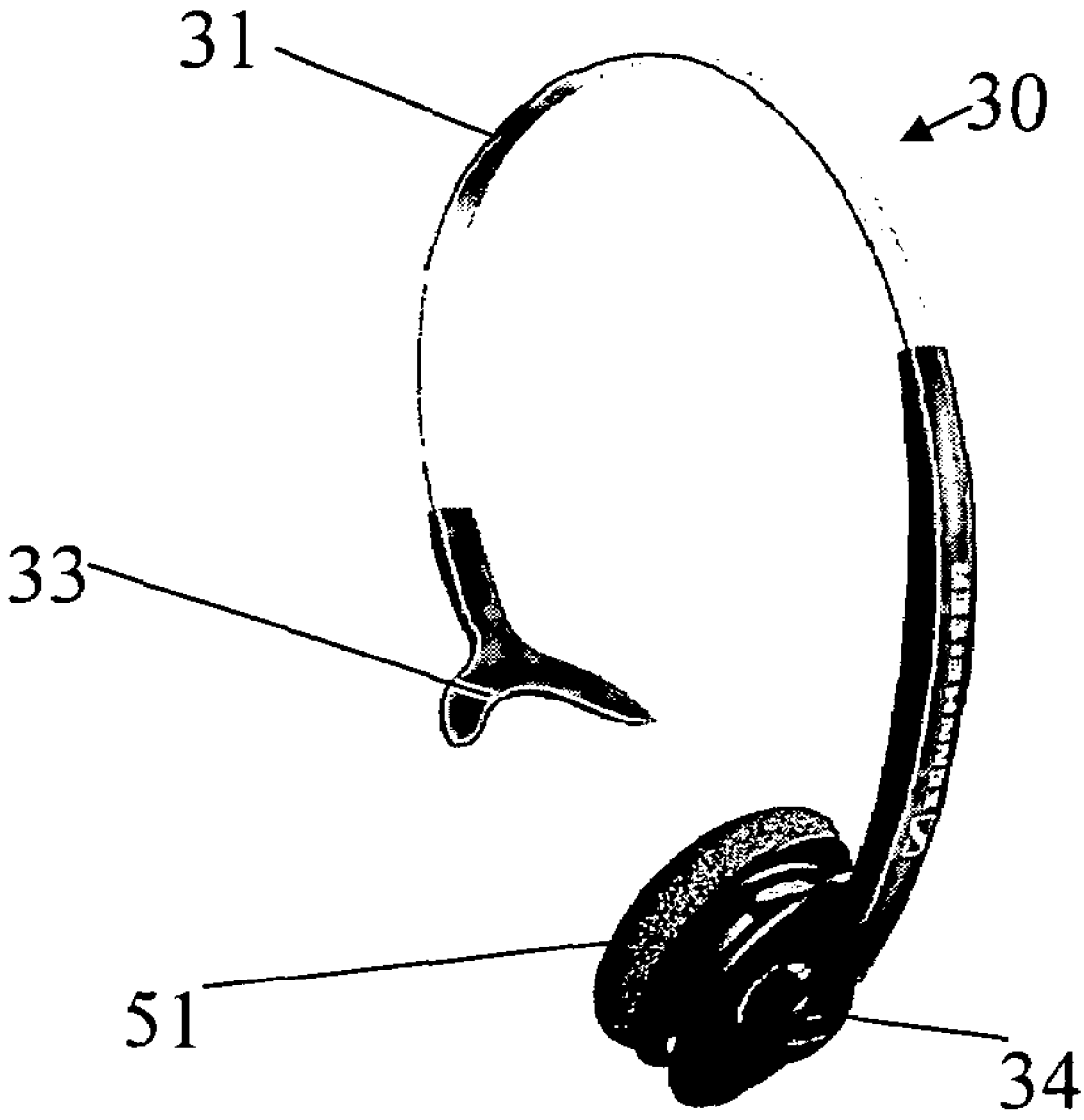
FIG. 6 is the headband in perspective view.

The shell 41 coupled to the headband 30 has a number of sound orifices 47 allowing the sound from the speaker enclosure to radiate away from the ear. This is important, with the speaker type chosen, in order not to disturb the sound field created by the speaker in the speaker enclosure 2. The shell 40 facing the ear has a central orifice 46 (seen in FIG. 5*c*) allowing free passage from speaker enclosure 2 to the ear. Further, the shell 40 has a radially extending collar 48 which allows an ear pad to be fastened to the shell. Thus the user may choose an ear-pad according to his or her liking. In FIG. 6 the headband 30 and shells 40,41 are shown with an ear-pad 51.

Figure 7:
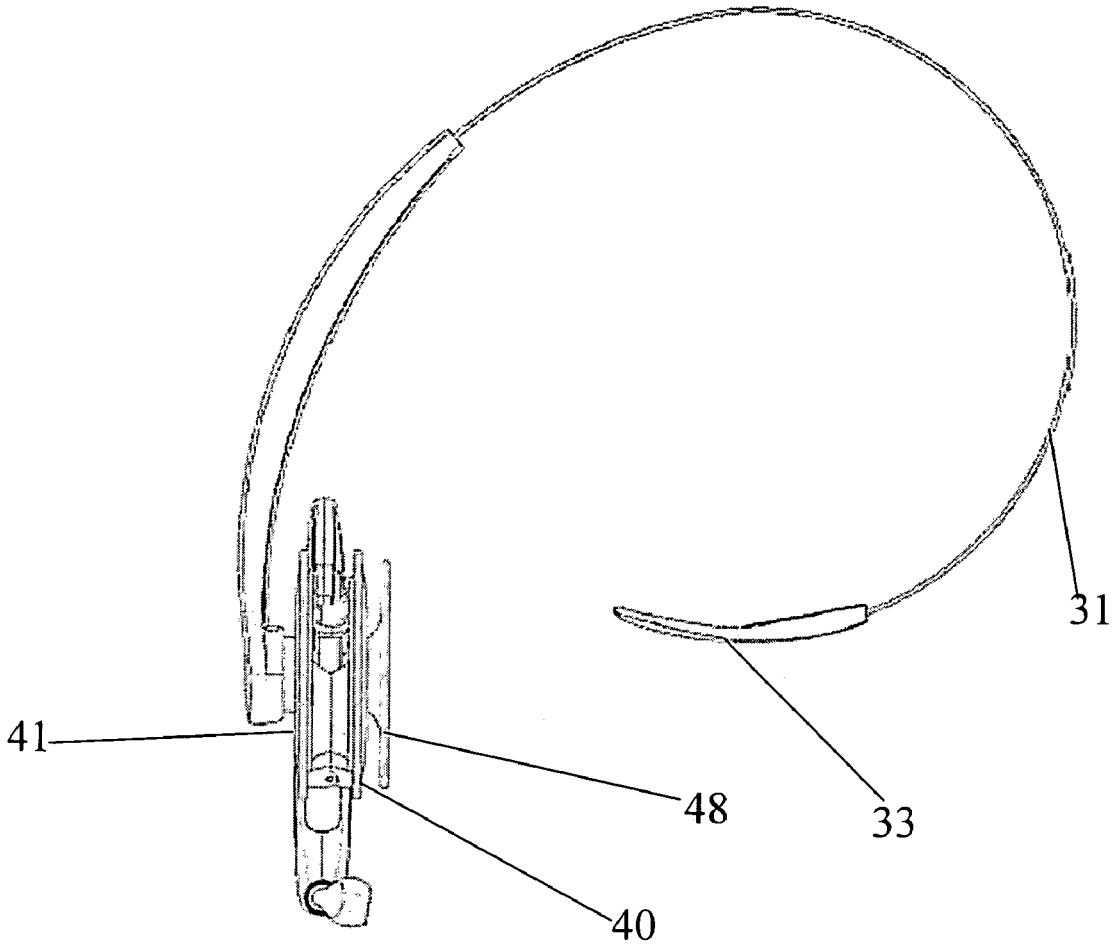
FIG. 7 is a front view of the headband and headset.

FIG. 7 displays a headband and headset assembly seen from the side. The collar 48 is clearly seen here.

Figure 8:
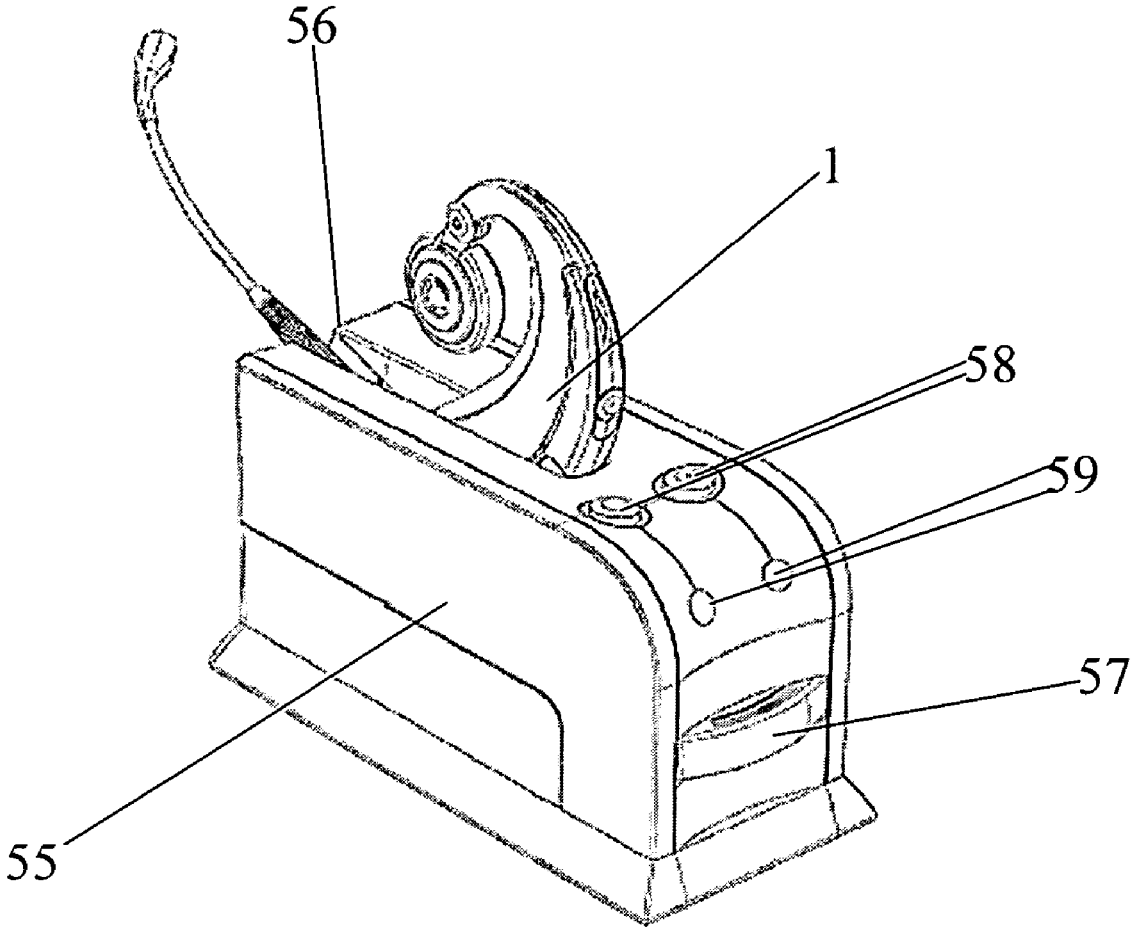
FIG. 8 is a perspective view of a base station and headset according to the invention.

In FIG. 8 a base station 55 for a headset is shown. The base station 55 has a box like shape with a furrow 56 in a top side thereof. The furrow 56 is shaped to receive the headset cabinet 1 with the microphone boom 4 and receiver enclosure part outside the furrow. Connection points on the cabinet 1 and inside the furrow will ensure connections for charging the battery of the headset, once placed in the base station 55. An extra battery 57 is provided in the base station allowing the user to switch battery during use of the device. Buttons 58 and indicator lights 59 are provided on the base station allowing pick up of incoming cal and other well known functions related to headsets.

The invention claimed is:

1. Headset comprising an elongate cabinet (1) adapted for placement behind the ear lobe (10), a speaker enclosure (2) fastened to the cabinet part (1) by a pivotal link (20) and extending from the upper part (11) of the cabinet (1) and a microphone boom (3) extending from the lower tip (13) of the cabinet (1), wherein the microphone boom (3) is fastened to the cabinet (1) in rotatable fashion, and wherein the speaker enclosure (2) has sound exit openings (15) pointing in directions towards the ear and away from the ear wherein the speaker enclosure (2) has a replaceable circumferentially extending band (4).

2. Headset as claimed in claim 1 wherein the speaker enclosure (2) is round.

3. Headset as claimed in claim 2 wherein the cross section of the band (4) has a V or U shaped profile (7) for engagement with corresponding profile (17) in the circumference of the speaker enclosure (2).

4. Headset as claimed in claim 1 wherein a short arm (18) is provided from the circumference of the speaker enclosure (2) to the pivotal link (20) at the upper part (11) of the headset cabinet (1) and further, the band (4) extending around the speaker enclosure (2) is interrupted in the area of the arm (18).

5. Headband (30) for a headset according to claim 1 whereby the headband (30) comprises a band (31) extending over the head (32) of a user and where the band (31) has a soft pad (33) for engaging the side of the head (32) of a user at one end thereof and a connector (34) for connecting a headset at the other end thereof, whereby the connector (34) comprises two shells (40,41) hinged to each other to allow a closing and opening movement and whereby the shells (40,41) defines a hollow space for accommodating a speaker enclosure (2) of a headset when the shells (40,41) are closed.

6. Headband as claimed in claim 5, wherein the hollow space is defined by a circumferential ridge portion (43) provided on at least one of the shells whereby the ridge portion (43) has at least two interruptions (44, 45) when the shells are closed to allow the arm (18) holding the speaker enclosure (2) to extend outside the enclosure in the area of the interruptions (44, 45).

7. Headband as claimed in claim 6, wherein the clamping shells (40,41) are both provided with sound openings (46,47) allowing sound from the speaker to radiate away from each the shells (40, 41).

8. Headband as claimed in claim 7, wherein the shell (40) facing the ear has a central sound guiding opening (46) and a radially extending collar (48).

* * * * *